United States Patent [19]

Eisenberg

[11] Patent Number: 5,035,299

[45] Date of Patent: Jul. 30, 1991

[54] METHOD AND DEVICE FOR EXTENSION LADDER SAFETY

[76] Inventor: Martin A. Eisenberg, 3577 NW. 16th Blvd., Gainesville, Fla. 32605

[21] Appl. No.: 561,149

[22] Filed: Aug. 1, 1990

[51] Int. Cl.[5] ..... E06C 7/06

[52] U.S. Cl. ..... 182/212

[58] Field of Search ..... 182/207, 209, 212

[56] References Cited

U.S. PATENT DOCUMENTS

| | | | |
|---|---|---|---|
| 201,844 | 3/1878 | Smith et al. . | |
| 1,151,809 | 8/1915 | Morgan | 182/207 |
| 1,359,297 | 11/1920 | Voss | 182/207 |
| 2,899,008 | 8/1959 | Larson | 182/207 |
| 4,210,224 | 7/1980 | Kummerlin | 182/207 |

FOREIGN PATENT DOCUMENTS

| | | |
|---|---|---|
| 2610265 | 9/1977 | Fed. Rep. of Germany . |
| 3611762 | 10/1986 | Fed. Rep. of Germany . |

*Primary Examiner*—Reinaldo P. Machado
*Attorney, Agent, or Firm*—Linda Flewellen Gould

[57] ABSTRACT

The safety of a user of an extension ladder may be increased by a method of testing whether a fly section has been properly extended and locked into position, which method also impedes inadvertent descent of the fly section. The method of increasing safety of using an extension ladder involves the use of a locking device, comprising an insertion pin designed to be inserted into an insertion hole extending from side to side of a rail on one section of the ladder. The insertion pin is attached to the side of a corresponding rail on the other section of the ladder. The attachment of the insertion pin and the location of the insertion hole are designed so that the insertion pin may be inserted into the insertion hole only when the fly section is properly positioned with respect to the base section, to ensure that rung locks are engaged to hold the fly section in place.

13 Claims, 2 Drawing Sheets

METHOD AND DEVICE FOR EXTENSION LADDER SAFETY

BACKGROUND OF THE INVENTION

1Technical Field

This invention pertains to a method and device for improving the safety of a user of an extension ladder. The method involves installation and use of a device to prevent a fly section of the extension ladder from accidentally descending.

2 Background Art

Extension ladders consist of a base section and one or more fly sections, each fly section extendable from the preceding section. The term "base section" shall be used herein to refer to the lower of two adjacent sections of an extension ladder, from which a fly section is extended upward. Thus, a "base section" may be the section of the ladder onto which the user first climbs, or may be a fly section extending from a previous base section, from which another fly section is extendable.

Most extension ladders rely on rung locks to hold a fly section in place, once it has been extended from a base section Rung locks are typically attached at one end to the interior of the dual rails on the fly section, in a manner which permits an open jaw at the other end of the rung locks to engage a rung on the base section. For ease in extending and contracting the fly section, rung locks are pivotally mounted so that they may be swung away from the rungs of the base section while the fly section is moved up or down.

Failure to properly engage rung locks is a frequent cause of ladder accidents. Falls from ladders account for hundreds of thousands of emergency room admissions each year. "Telescoping" of extension ladders due to false latching or improperly engaged rung locks precipitate many such accidents. If a rung lock is not properly engaged, the fly section of the extension ladder may telescope or descend in a rapid and uncontrolled manner, causing the user to fall. The potential danger is exacerbated by the fact that misaligned rung locks are not always observable from the ground.

In some cases, rung locks may be only partially misaligned, permitting the fly section to be held in place while the user ascends the ladder. However, forces associated with the descent of the user may cause the improperly engaged rung locks to become disengaged, resulting in a telescoping accident as the user descends from the top of the fly section.

Various devices are known in the prior art for decreasing the possibility of an accidental descent of an extension ladder fly section. In U.S. Pat. No. 201,844 to Smith et al., a hook type rung lock is used to secure ladder sections in an extended position. A spring loaded friction brake is also described, attached to the interior of a rail of the base section. The brake purposely establishes resistance as a fly section is lowered, to slow its descent. The brake is not designed to lock the fly section in place.

West German Patent No. 2610265 describes a spring action locking pin for use with extension ladders. The locking pin is inserted through a hole in the rail of the fly section, from back to front, extending beneath the top rung of the base section. A hook like connector attached to the fly section extends around the top and side of that top rung.

Similarly, West German Patent No. 3611762 describes an attachment to the interior of the rail of a fly section. A hook and latch combination is used to engage the exterior of the top rung of the base section.

Although each of the extension ladder locking devices known in the prior art has particular advantages and purposes, there exists a need for an extension ladder safety device which will serve three purposes:

a. provide a test and indicator of an improper rung lock position,
b. inhibit disturbance of a properly latched fly section, and
c. provide a back-up locking mechanism in addition to properly engaged rung locks.

DISCLOSURE OF THE INVENTION

SUMMARY OF THE INVENTION

An object of this invention is to provide a method of determining, by observation prior to stepping on an extension ladder, whether the rung locks holding a fly section in place are improperly engaged.

Another object of this invention is to provide a device capable of inhibiting disturbance of a properly latched fly section, to decrease the possibility of a fly section "telescoping" while in use.

Yet another object of this invention is to provide a back-up locking mechanism in addition to properly engaged rung locks, to lock into place an extended fly section.

The safety device used in this method of increasing safety of extension ladders may be installed on either the base section or fly section of the extension ladder. As with all common extension ladders, each section of the ladder has two rails and a plurality of rungs. An insertion hole must be formed in one rail, extending through the thickness of the rail from on side of that rail to the other. The insertion hole is formed in a rail corresponding to the rail to which the safety device is attached, but on the section of the ladder other than the section to which the safety device is attached. In one embodiment of the invention, a hole already existing in each rail, located adjacent to and extending into a hollow rung, may serve as the insertion hole.

The safety device comprises an insertion pin, suitable for inserting into the insertion hole, and an attachment means for attaching the insertion pin to a rail of the section of the ladder other than the section having the insertion hole. The insertion pin must be attached to the rail in a position with respect to the insertion hole so that the insertion pin can be inserted through the insertion hole only when the fly section of the ladder is positioned with respect to the base section so that the rung locks are properly engaged and the fly section cannot descend.

In one embodiment of the invention, the attachment means comprises an insertion rod, a spring, and a holding means. The insertion rod is inserted into an attachment hole extending from one side of a rail to the other, at the conjunction of that rail and a rung, so that the insertion rod may be inserted through the attachment hole into the interior of the hollow attachment rung. The spring is connected at one end to the insertion rod, and at the other end to the holding means. Thus, when the insertion rod is inserted into the attachment hole, the spring is pushed through the hollow attachment rung, and may be pulled through hole in the opposing rail, also adjacent to the attachment rung. The holding means then holds one end of the spring in place at the hole in the opposing rail at the end of the attachment rung, preventing the insertion rod from being pulled out of the attachment hole.

In this embodiment, the insertion rod may be conveniently connected to the insertion pin by a connecting bar. The insertion rod and insertion pin may be held parallel to each other by the connecting bar, which connecting bar is perpendicular to and attached to one end of both the insertion rod and the insertion pin. By properly selecting the length of the connecting bar and the shape of the insertion pin, it can be assured that the insertion rod of the attachment means and the insertion pin cannot both be inserted into the attachment hole and insertion hole respectively, unless the fly section is positioned with respect to the base section so that the rung locks cannot be improperly engaged.

The embodiment of the safety device just described is particular useful for extension ladders having holes at the conjunction of each rung with each rail. By utilizing existing holes in the rails, adjacent to hollow rungs, to insert both the insertion rod and the insertion pin, no additional holes must be formed in the rails to utilize the safety method described herein. A hole may be formed in the rail to which the attachment means is attached, if desired, in which to keep the insertion pin when the fly section is not extended, or is in the process of adjustment.

This method of preventing a fly section from accidentally descending may also be practiced by using a device comprising a plate attached to a side of one rail of the ladder, a hollow cylinder attached to the plate extending outward from the plate and from the side of the rail to which the plate is attached, an insertion pin which can be inserted through the cylinder and through a hole in the plate into an insertion hole formed in the corresponding rail on the other section of the ladder, and a movement means for moving the insertion pin through the cylinder and plate into the insertion hole. The insertion hole formed in the rail of the section of the ladder other than the section to which the plate is attached extends from side to side through the thickness of the rail, and is positioned so that the insertion pin can be inserted only when the fly section is aligned with respect to the base section so that the rung locks can be properly engaged The cylinder attached to the plate, through which the insertion pin is inserted, may be configured to include a spiral groove through which a crossbar may be rotated. By attaching the crossbar to the insertion pin, the insertion pin may be moved in or out of the insertion hole, by rotation of the crossbar. A cord may be conveniently attached to each end of the crossbar to facilitate rotation of the crossbar from the ground, even when the insertion pin is too far from the ground to reach.

In each of these and other embodiments of the invention, the device may be easily viewed by an observer who has not yet ascended the ladder. If the observer attempts to insert the insertion pin in the insertion hole, but is unable to do so, he is immediately warned that the fly section may not be properly positioned with respect to the base section to allow the rung locks to properly engage. Thus, this method of ladder safety allows the user to test whether rung locks are properly engaged, prior to ascending the ladder. To increase the ease of testing whether the fly section is held in place, the insertion pin may be painted red so that it can be clearly differentiated from the rest of the device to determine whether insertion in the insertion hole has been accomplished.

Use of such a ladder safety device also inhibits disturbance of a properly latched fly section, as well as providing a back-up locking mechanism. Once the insertion pin has been inserted in the insertion hole one rail of the fly section is held in place adjacent to the corresponding rail of the base section, by the insertion pin, greatly decreasing the possibility that the fly section might be sufficiently moved with respect to the base section to permit the rung locks to disengage.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

DETAILED DESCRIPTION OF THE PREFERRED EMBODIMENT

Figure 1:
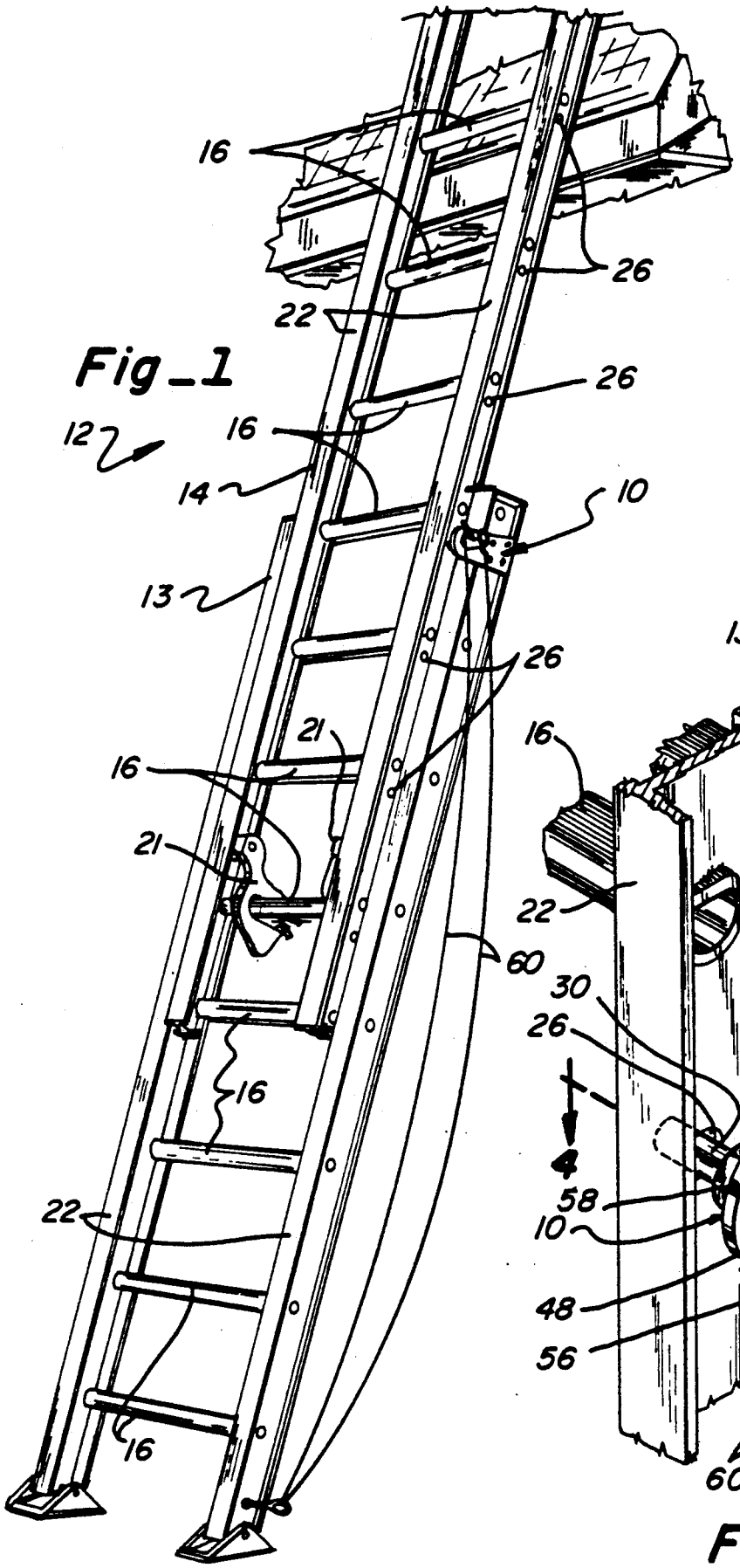
FIG. 1 is perspective view of a ladder, to which a ladder safety device of the present invention has been attached.

The method of increasing safety in using extension ladders according to the present invention can be better understood by reference to FIG. 1. A ladder 12 has at least two sections, a base section 13 and a fly section 14 which may be extended upwards from the base section 13. Each section 13,14 of the ladder 12 has two rails 22, and a plurality of rungs 16 attached at each end to one of the two rails 22. When the fly section 14 is extended upward from the base section 13, the fly section 14 is held in place by rung locks 21 extending from the fly section 14 to engage one of the rungs 16 of the base section 13. However, if rung locks 21 are not properly engaged, the fly section 14 may accidently retract, and descend onto the base section 13.

A locking device 10 may be used to both test for improper alignment of the fly section 14 with respect to the base section 13, and to inhibit unintentional lowering of the fly section 14. The locking device 10 may comprise an insertion pin 30 and an attachment means 28 The insertion pin 30 is designed to be inserted into an insertion hole 26 formed in one rail 22 of either the base section 13 or the fly section 14. The insertion hole 26 extends from side to side through the thickness of the rail 22. Some embodiments of the locking device 10 permit use of an existing hole in a rail 22, such as a hole adjacent to a hollow rung 16, as the insertion hole 26.

The attachment means 28 connects the insertion pin 30 to one rail 22 of either the fly section 14 or the base section 13, which rail 22 may conveniently be on the same side of the ladder 12 as the insertion hole 26, but on the section 13 or 14 of the ladder 12 other than the section 13,14 in which the insertion hole 26 is formed. Thus, if the attachment means 28 is connected to the fly section 14, the insertion hole 26 will be formed in a corresponding rail 22 on the base section 13; while the insertion hole 26 will be formed in a rail 22 on the fly section 14 if the attachment means 28 is connected to the base section 13. The insertion hole 26, the attachment means 28, and the insertion pin 30 are aligned so that the insertion pin 30 may be inserted into the insertion hole 26, only when the base section 13 and the fly section 14 are positioned so that the fly section 14 can be stably held in place by rung locks 21 engaging one rung 16 of the base section 13

Figure 7:
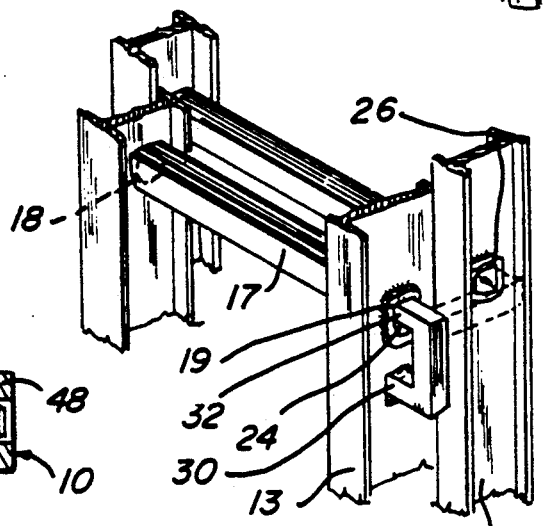
FIG. 7 is a perspective view of another embodiment of the ladder safety device described herein, installed in an extension ladder.
Figure 8:
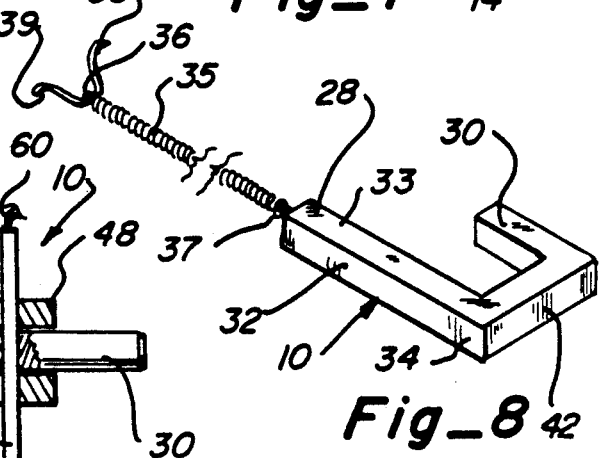
FIG. 8 is a perspective view of the embodiment shown in FIG. 7, removed from the extension ladder.

Some extension ladders are configured so that each rung 16 is hollow, and a hole is formed in each rail 22 at each conjunction of a hollow rung 16 and the rail 22. An easily installed embodiment of the locking device 10 usable with such ladders comprises an insertion pin 30, attached to the attachment means 28, which attachment means 28 conveniently comprises a connecting bar 42, an insertion rod 32, a spring 35, and a holding means 38. The insertion pin 30, connecting bar 42, and insertion rod 32 may be advantageously formed as a single part for manufacturing economy, or in modular design to facilitate the production of different shaped insertion pins and different insertion pin/insertion rod spacings to accommodate dimensional variations in different ladder models. As shown in FIGS. 7 and 8, the insertion pin 30 may be held parallel to the insertion rod 32 by the connecting bar 42, which connecting bar 42 is perpendicular to and attached to one end of both the insertion rod 32 and the insertion pin 30.

In the embodiment of the locking device 10 shown in FIGS. 7 and 8, the attachment means 28 comprises the connecting bar 42, the insertion rod 32, the spring 35, and the holding means 38. The insertion rod 32 is configured to fit into an attachment hole 24. Any of the holes formed in each rail 22 at each conjunction of a hollow rung 16 and the rail 22 may be conveniently used as the attachment hole 24. The spring 35 is attached at its insertion end 37 to the insertion rod 32, and at its retainer end 36 to the holding means 38. As the spring 35 extends parallel to the insertion rod 32, it may be inserted through the attachment hole 24 into the attachment rung 17 which adjoins the attachment hole 24. The holding means 38 is then used to keep the spring 35 in place, within the attachment rung 17. The holding means 38 may simply comprise a plate, a cap, or one or more hooks 39, designed to emerge from and clasp against the retainer end 18 of the attachment rung 17, which retainer end 18 is opposite the attachment hole 24.

By properly selecting the length of the connecting bar 42 and the shape of the insertion pin 30, it can be assured that the insertion rod 32 of the attachment means 28 and the insertion pin 30 cannot both be inserted into the attachment hole 24 and insertion hole 26 respectively, unless the fly section 14 is positioned with respect to the base section 13 so that the rung locks 21 can be properly engaged. The length of the connecting bar 42 will most conveniently be equal to the distance between the insertion hole 26 formed in one section 13,14 of the ladder 12, and the attachment hole 24 formed in the other section 13,14, when the fly section 14 is positioned with respect to the base section 13 so that the rung locks 21 can properly engage a rung 16 of the base section 13.

The embodiment of the locking device 10 shown in FIGS. 1-6 depends on formation of an insertion hole 26 extending from side to side through the thickness of one rail 22 of either the base section 13 or the fly section 14. Unlike the embodiment shown in FIGS. 7 and 8, the insertion pin 30 is attached to the other section 13,14 of the ladder 12 at a position which is not necessarily adjacent to the conjunction of a rail 22 and an attachment rung 17. Once the location of the insertion pin 30 along the rail 22 has been secured by the attachment means 28, the insertion hole 26 may be formed at a position along the corresponding rail 22 of the other section 13,14 so that the insertion pin 30 may be inserted in the insertion hole 26 only when the fly section 14 is positioned with respect to the base section 13 so that the rung locks 21 can be properly engaged. Multiple insertion holes 26 may be formed in each rail 22, to accommodate insertion of the insertion pin 30 at each position in which the rung locks 21 can properly engage one of the multiple rungs 16.

Figure 2:
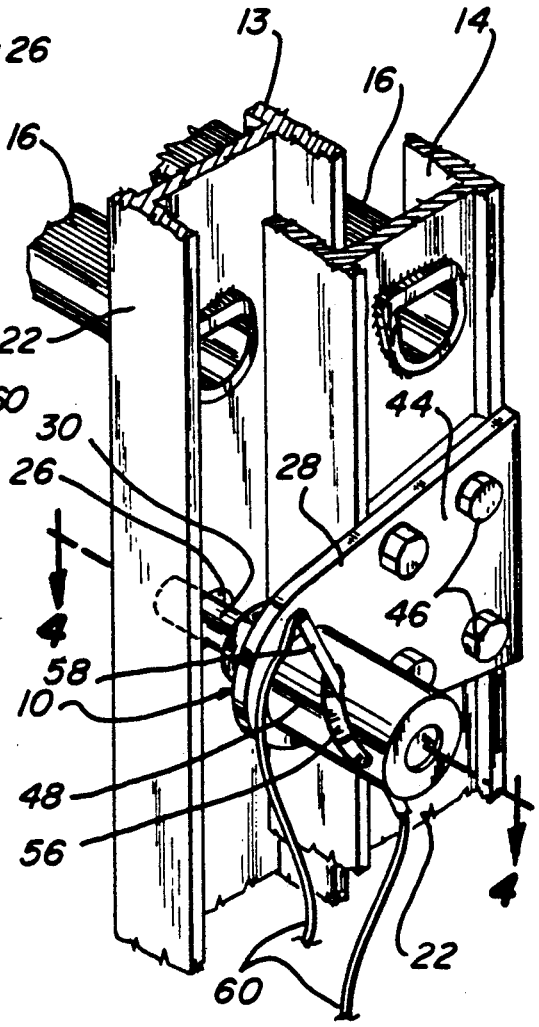
FIG. 2 is a perspective view of one embodiment of the ladder safety device described herein, with an insertion pin inserted in an insertion hole.
Figure 3:
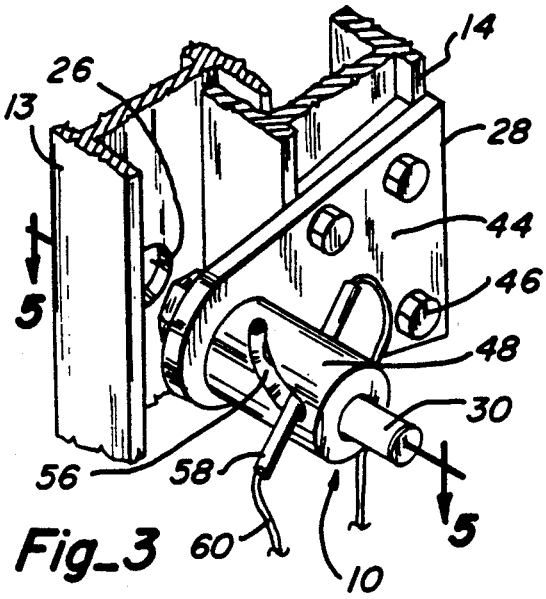
FIG. 3 is a perspective view of the ladder safety device, with the insertion pin withdrawn from the insertion hole.
Figure 6:
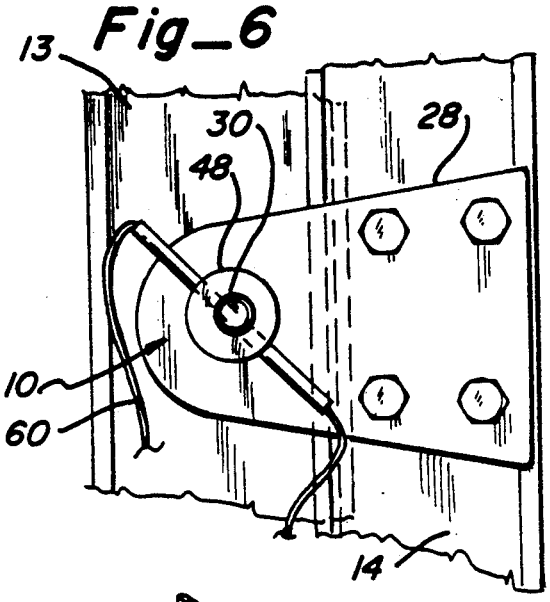
FIG. 6 is a side view of the ladder safety device, according to the present invention.
Figure 4:
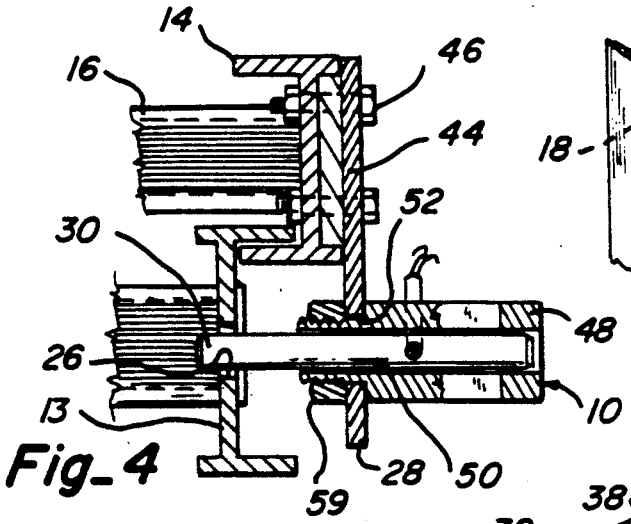
FIG. 4 is a section view taken from FIG. 2 of the ladder safety device.

As is best shown in FIGS. 2 and 3, the attachment means 28 may advantageously comprise a plate 44, a cylinder 48 attached to the plate 44, and a movement means for moving the insertion pin 30 relative to the plate 44. The plate 44 is shaped so that it may be attached to a side of a rail 22 of the section 13,14 of the ladder 12 other than the section 13,14 in which the insertion hole 26 is formed. As can be viewed in FIGS. 4 and 5, a plate hole 52 is formed in the plate 44, suitable for receiving the insertion pin 30.

The cylinder 48 is attached to the plate 44 so that the cylinder 48 extends from the plate 44 perpendicular to the plate 44 and away from the side of the rail 22 to which the plate 44 is attached. A cylinder hole 50 is formed in the cylinder 48, aligned with the plate hole 12, so that the insertion pin 30 may be moved through the plate hole 52 and through the cylinder hole 50. The cylinder 48 may be adhesively bonded to the plate 44, or may be made in two pieces sandwiched around the plate 44, or press fit into the plate 44. In yet another mode of construction, the cylinder 48 may be threaded into a hole 52 in the plate 44, and held in place by a nut 59 on the opposite side of the plate 44.

Figure 5:
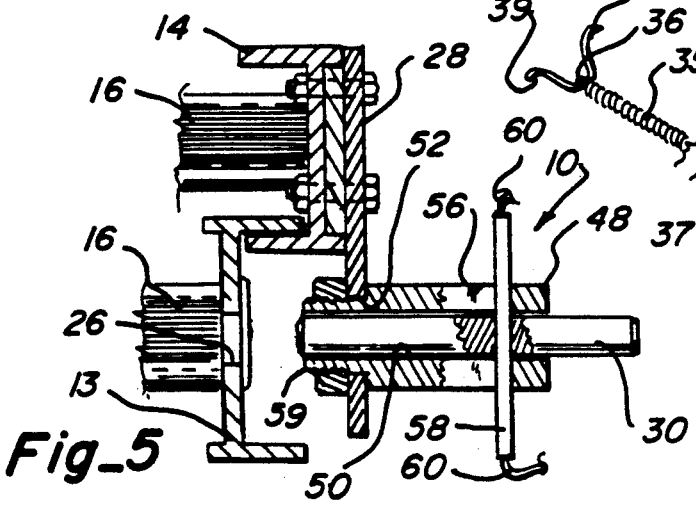
FIG. 5 is a section view taken from FIG. 3 of the ladder safety device.

When the insertion pin 30 resides in the cylinder hole 50 but has not been inserted into the insertion hole 26, the insertion pin 30 is visible to a user of the ladder 12, as shown in FIGS. 3 and 5. The user is then alerted that the insertion pin 30 has not been inserted into the insertion hole 26, and that the fly section 14 may not be properly positioned to permit proper engagement of the rung locks 21. The user may attempt to insert the insertion pin 30 into the insertion hole 26, to determine whether the fly section 14 is properly positioned to prevent descent of the fly section 14.

A number of methods of moving the insertion pin 30 into the insertion hole 26 are possible. In the embodiment shown in FIGS. 2 and 3, a spiral groove 56 is conveniently formed in the cylinder 48, permitting a crossbar 58 extending through the cylinder 48 to be rotated through the spiral groove 56. When the crossbar 58 is connected to the insertion pin 30, rotation of the crossbar 58 will cause the insertion pin 30 to move towards or away from the insertion hole 26 Thus, as the crossbar 58 is rotated from the position shown in FIG.

3, to the position shown in FIG. 2, the insertion pin 30 is moved through the cylinder hole 50 and through the plate hole 52 toward the rail 22 in which the insertion hole 26 is formed. If the fly section 14 is positioned to permit proper engagement of the rung locks 21, the insertion hole 26 will be positioned to receive the insertion pin 30, as the insertion pin 30 is so moved by rotation of the crossbar 58. If the fly section 1 is positioned so that the rung locks 21 are not properly engaged, resulting in a possible descent of the fly section 14, rotation of the crossbar 58 will be impeded when the insertion pin 30 cannot be inserted into the insertion hole 26.

A cord 60 may be attached to either end of the crossbar 58, to permit the crossbar 58 to be rotated by the user pulling the cord 60, even if the plate 44 is attached to the ladder 12 at a position too high to be reached from the ground. When the user has safely descended from the ladder 12, the insertion pin 30 may be retracted from the insertion hole 26, by rotation of the crossbar 58, to permit the rung locks 21 to be disengaged and the fly section 14 to be lowered.

The locking device 10 may be made from any structurally sound engineering material such as aluminum or steel alloy or fiber reinforced polymeric composite, that is appropriately resistant to environmental degradation and wear and tear of anticipated ladder usage.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

I claim:

1. A device for preventing unintentional lowering of a fly section of an extension ladder with respect to a base section of the ladder, each section of the ladder having two rails and a plurality of rungs, one rail of one of the ladder sections having at least one insertion hole formed therein extending from one side of the rail to the other, comprising:

a. insertion pin shaped to fit into the insertion hole formed in a rail of a ladder section, said insertion hole extending from one side of the rail to the other, and b. attachment means for attaching the insertion pin to a rail of the section of the ladder other than the section having the insertion hole, wherein, the insertion pin and attachment means are aligned with respect to the insertion hole so that the insertion pin can be inserted through the insertion hole only when the fly section of the ladder is positioned with respect to the base section so as to permit the fly section to be held in place with respect to the base section.

2. A device as described in claim 1, wherein the attachment means further comprises:

a. an insertion rod, having a spring end and a connecting end, shaped to fit into an attachment hole formed in a rail of the section of the ladder other than the section having the insertion hole, said attachment hole extending from one side of the rail to the other, said attachment hole being aligned with an attachment rung so that the insertion rod can be inserted through the attachment hole into an insertion end of the attachment rung, b. a spring having a retainer end and an insertion end, attached at the insertion end to the spring end of the insertion rod and extending parallel to the insertion rod, of a length sufficient to permit the spring to be extended from the insertion rod inserted in the attachment hole, through the insertion end of the attachment rung, through the attachment rung, to a retainer end of the attachment rung opposite the insertion end, c. holding means attached to the retainer end of the spring, and d. connecting means for connecting insertion pin to insertion rod.

3. A device as described in claim 2, wherein said holding means comprises at least one hook to engage the retainer end of the attachment rung, attached to the retainer end of the spring.

4. A device as described in claim 2, wherein said holding means comprises a plate attached to the retainer end of the spring, which plate may engage the retainer end of the attachment rung, to prevent the spring from retracting into the attachment rung.

5. A device as described in claim 2, wherein said holding means comprises a cap attached to the retainer end of the spring, which cap may engage the retainer end of the attachment rung, to prevent the spring from retracting into the attachment rung.

6. A device as described in claim 2, wherein the connecting means further comprises a connecting bar attached at one end to one end of the insertion pin and attached at the other end to the connecting end of the insertion rod, which connecting bar positions the insertion pin parallel to the insertion rod.

7. A device as described in claim 1, wherein said attachment means further comprises:

a. a plate shaped to be attached to a side of a rail of the section of the ladder other than the section having the insertion hole, having a plate hole formed therein to permit the insertion pin to be moved through the plate hole, said plate being attached to the side of the rail so as to align the plate hole so that the insertion pin may be inserted through the plate hole into the insertion hole, b. a cylinder attached to the plate, extending from the plate perpendicular to the plate away from the side of the rail to which the plate is attached, having a cylinder hole formed therein aligned with the plate hole so that the insertion pin ma be moved through the plate hole and through the cylinder hole, and c. movement means for moving the insertion pin through the cylinder hole and the plate hole into the insertion hole.

8. A device as described in claim 7, wherein said movement means further comprises:

crossbar attached to the insertion pin so that rotation of the crossbar causes the insertion pin to be moved toward or away from the insertion hole.

9. A device as described in claim 8, wherein the cylinder has a spiral groove formed therein, said spiral groove positioned so that the crossbar attached to the insertion pin can be rotated within said spiral groove, as the crossbar extends from the insertion pin inside the cylinder hole through the spiral groove to an area exterior to the cylinder, such rotation causing the insertion pin to be moved toward or away from the insertion hole.

10. A device as described in claim 9, wherein a cord is attached to at least one end of the crossbar, so that the crossbar may be rotated by pulling the cord.

11. A method for preventing unintentional lowering of a fly section of an extension ladder with respect to a base section of the ladder, each section of the ladder having two rails and a plurality of rungs, comprising the steps of:

a. forming an insertion hole in one rail of one of the ladder sections extending from one side of the rail to the other, b. alinging an insertion pin in an aligned position with respect to the insertion hole so that ht insertion pin can be inserted through the insertion hole only when the fly section of the ladder is positioned with respect to the base section so as to permit the fly section to be held inplace with respect to the base section, and c. attaching the insertion pin to the section of the ladder other than the section having the insertion hole, in the aligned position.

12. A method as described in section 11, comprising the further steps of:

d. attaching a plate to a side of a rail of the section of the ladder other than the section having the insertion hole, having a plate hole formed therein sufficient to permit the insertion pin to be moved through the plate hole, so as to align the plate hole so that the insertion pin may be inserted through the plate hole into the insertion hole, e. attaching to the plate a cylinder, extending from the plate perpendicular to the plate away from the side of the rail to which the plate is attached, having a cylinder hole formed therein aligned with the plate hole so that the insertion pin may be moved through the plate hole and through the cylinder hole, and f. moving the insertion pin through the cylinder hole and the plate hole into the insertion hole.

13. A method for preventing unintentional lowering of a fly section of an extension ladder with respect to a base section of the ladder, each section of the ladder having two rails and a plurality of rungs, one rail of one section of the ladder having an insertion hole formed therein extending from one side of the rail to the other, and one rail of the other section of the ladder having an attachment hole formed therein extending from one side of the rail to the other, said attachment hole being aligned with and adjacent to an attachment rung, comprising the steps of:

a. attaching an insertion pin to an insertion rod, so that the insertion pin is parallel to the insertion rod and a distance away from the insertion rod so that the insertion pin can be inserted through the insertion hole and the insertion rod can be inserted through the attachment hole only when the fly section of the ladder is positioned with respect to the base section so as to permit the fly section to be held in place with respect to the base section, and b. inserting the insertion rod through the attachment hole, c. securing the insertion rod in the attachment hole, and d. inserting the insertion pin into the insertion hole.

* * * * *